US007484548B2

(12) United States Patent
Jacques et al.

(10) Patent No.: US 7,484,548 B2
(45) **Date of Patent: *Feb. 3, 2009**

(54) CONTINUOUS CASTING OF REACTIONARY METALS USING A GLASS COVERING

(75) Inventors: Michael P. Jacques, Canton, OH (US); Frank P. Spadafora, Niles, OH (US); Kuang-O Yu, Highland Heights, OH (US); Brian W. Martin, N. Canton, OH (US)

(73) Assignee: RMI Titanium Company, Niles, OH (US)

( * ) Notice: Subject to any disclaimer, the term of this patent is extended or adjusted under 35 U.S.C. 154(b) by 77 days.

This patent is subject to a terminal disclaimer.

(21) Appl. No.: 11/433,107

(22) Filed: May 12, 2006

(65) Prior Publication Data

US 2006/0254746 A1 Nov. 16, 2006

Related U.S. Application Data

(63) Continuation-in-part of application No. 10/989,563, filed on Nov. 16, 2004, now Pat. No. 7,322,397.

(51) Int. Cl.
*B22D 11/10* (2006.01)

(52) U.S. Cl. ..... 164/268; 164/439

(58) Field of Classification Search ..... 164/439, 164/263, 268, 472, 488, 256, 513
See application file for complete search history.

(56) References Cited

U.S. PATENT DOCUMENTS

| | | | | | |
|---|---|---|---|---|---|
| 2,709,842 | A * | 6/1955 | Findlay | 164/413 |
| 2,858,586 | A * | 11/1958 | Brennan | 164/471 |
| 2,858,588 | A | 11/1958 | Brennan | |
| 2,903,759 | A | 9/1959 | Brennan | |
| 3,396,778 | A | 8/1968 | Jensen et al. | |
| 3,470,939 | A | 10/1969 | Coad | |
| 3,561,399 | A * | 2/1971 | Federman | 118/65 |
| 3,888,300 | A | 6/1975 | Guichard et al. | |
| 4,024,309 | A | 5/1977 | Pender | |
| 4,391,319 | A | 7/1983 | Heaslip et al. | |
| 4,533,243 | A * | 8/1985 | Zhukov et al. | 356/44 |
| 6,868,896 | B2 | 3/2005 | Jackson et al. | |
| 7,322,397 | B2 * | 1/2008 | Jacques et al. | 164/439 |
| 2007/0204970 | A1 * | 9/2007 | Jacques et al. | 164/263 |

* cited by examiner

*Primary Examiner*—Kevin P Kerns
(74) *Attorney, Agent, or Firm*—Sand & Sebolt

(57) ABSTRACT

A seal for a continuous casting furnace having a melting chamber with a mold therein for producing a metal cast includes a passage between the melting chamber and external atmosphere. As the cast moves through the passage, the cast outer surface and the passage inner surface define therebetween a reservoir for containing liquid glass or other molten material to prevent the external atmosphere from entering the melting chamber. Particulate material fed into the reservoir is melted by heat from the cast to form the molten material. The molten material coats the cast as it moves through the passage and solidifies to form a coating to protect the hot cast from reacting with the external atmosphere. Preferably, the mold has an inner surface with a cross-sectional shape to define a cross-sectional shape of the cast outer surface whereby these cross-sectional shapes are substantially the same as a cross-sectional shape of the passage inner surface.

31 Claims, 9 Drawing Sheets

CONTINUOUS CASTING OF REACTIONARY METALS USING A GLASS COVERING

CROSS REFERENCE TO RELATED APPLICATIONS

This application is a continuation-in-part of U.S. patent application Ser. No. 10/989,563, filed Nov. 16, 2004, now U.S. Pat. No. 7,322,397; the disclosure of which is incorporated herein by reference.

BACKGROUND OF THE INVENTION

1. Technical Field

The invention relates generally to the continuous casting of metals. More particularly, the invention relates to the protection of reactionary metals from reacting with the atmosphere when molten or at elevated temperatures. Specifically, the invention relates to using a molten material such as liquid glass to form a barrier to prevent the atmosphere from entering the melting chamber of a continuous casting furnace and to coat a metal cast formed from such metals to protect the metal cast from the atmosphere.

2. Background Information

Hearth melting processes, Electron Beam Cold Hearth Refining (EBCHR) and Plasma Arc Cold Hearth Refining (PACHR), were originally developed to improve the quality of titanium alloys used for jet engine rotating components. Quality improvements in the field are primarily related to the removal of detrimental particles such as high density inclusions (HDI) and hard alpha particles. Recent applications for both EBCHR and PACHR are more focused on cost reduction considerations. Some ways to effect cost reduction are increasing the flexible use of various forms of input materials, creating a single-step melting process (conventional melting of titanium, for instance, requires two or three melting steps) and facilitating higher product yield.

Titanium and other metals are highly reactive and therefore must be melted in a vacuum or in an inert atmosphere. In electron beam cold hearth refining (EBCHR), a high vacuum is maintained in the furnace melting and casting chambers in order to allow the electron beam guns to operate. In plasma arc cold hearth refining (PACHR), the plasma arc torches use an inert gas such as helium or argon (typically helium) to produce plasma and therefore the atmosphere in the furnace consists primarily of a partial or positive pressure of the gas used by the plasma torches. In either case, contamination of the furnace chamber with oxygen or nitrogen, which react with molten titanium, may cause hard alpha defects in the cast titanium.

In order to permit extraction of the cast from the furnace with minimal interruption to the casting process and no contamination of the melting chamber with oxygen and nitrogen or other gases, current furnaces utilize a withdrawal chamber. During the casting process the lengthening cast moves out of the bottom of the mold through an isolation gate valve and into the withdrawal chamber. When the desired or maximum cast length is reached it is completely withdrawn out of the mold through the gate valve and into the withdrawal chamber. Then, the gate valve is closed to isolate the withdrawal chamber from the furnace melt chamber, the withdrawal chamber is moved from under the furnace and the cast is removed.

Although functional, such furnaces have several limitations. First, the maximum cast length is limited to the length of the withdrawal chamber. In addition, casting must be stopped during the process of removing a cast from the furnace. Thus, such furnaces allow continuous melting operations but do not allow continuous casting. Furthermore, the top of the cast will normally contain shrinkage cavities (pipe) that form when the cast cools. Controlled cooling of the cast top, known as a "hot top", can reduce these cavities, but the hot top is a time-consuming process which reduces productivity. The top portion of the cast containing shrinkage or pipe cavities is unusable material which thus leads to a yield loss. Moreover, there is an additional yield loss due to the dovetail at the bottom of the cast that attaches to the withdrawal ram.

The present invention eliminates or substantially reduces these problems with a sealing apparatus which permits continuous casting of the titanium, superalloys, refractory metals, and other reactive metals whereby the cast in the form of an ingot, bar, slab or the like can move from the interior of a continuous casting furnace to the exterior without allowing the introduction of air or other external atmosphere into the furnace chamber.

BRIEF SUMMARY OF THE INVENTION

The present invention provides an apparatus comprising a continuous casting mold adapted for producing a metal cast having an outer periphery; a molten bath of a coating material disposed below the mold and adapted for applying a coating of molten material to an outer periphery of the metal cast to produce a coated metal cast; and a cutting mechanism disposed below the molten bath and adapted for cutting the coated metal cast while extending downwardly from the mold to form cut segments of the coated metal cast.

The present invention also provides an apparatus comprising a continuous casting mold adapted for producing a metal cast having an outer periphery; a molten bath of a coating material disposed below the mold and adapted for applying a coating of molten material to the outer periphery of the metal cast to produce a coated metal cast; a metal cast pathway extending from adjacent the mold to adjacent the molten bath and adapted for movement of the metal cast therein from the mold to the molten bath; and a first heat source disposed below the mold, above the molten bath and adjacent the pathway whereby the first heat source is adapted for heating the metal cast as it moves along the pathway.

The present invention further provides an apparatus comprising a continuous casting mold adapted for producing a metal cast having an outer periphery; a molten bath of a coating material disposed below the mold and adapted for applying a coating of molten material to the outer periphery of the metal cast to produce a coated metal cast; and a source of particulate material and a dispenser for dispensing the particulate material to a location adjacent the molten bath.

BRIEF DESCRIPTION OF THE SEVERAL VIEWS OF THE DRAWINGS

Similar numbers refer to similar parts throughout the drawings.

DETAILED DESCRIPTION OF THE INVENTION

Figure 1:
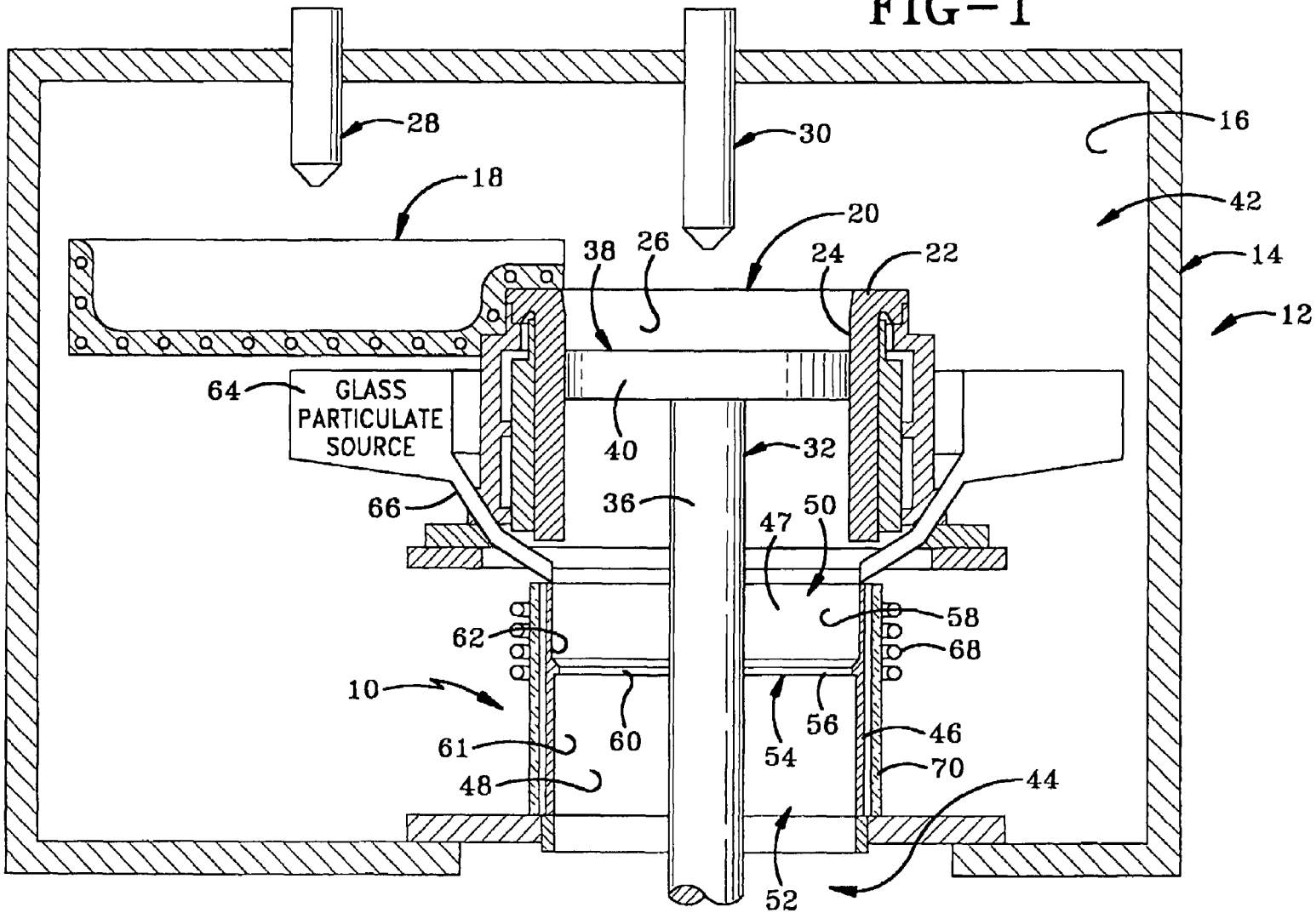
FIG. 1 is a sectional view of the seal of the present invention in use with a continuous casting furnace.

The seal of the present invention is indicated generally at 10 in FIGS. 1-5 in use with a continuous casting furnace 12. Furnace 12 includes a chamber wall 14 which encloses a melting chamber 16 within which seal 10 is disposed. Within melting chamber 16, furnace 12 further includes a melting/refining hearth 18 in fluid communication with a mold 20 having a substantially cylindrical sidewall 22 with a substantially cylindrical inner surface 24 defining a mold cavity 26 therewithin. Heat sources 28 and 30 are disposed respectively above melting/refining hearth 18 and mold 20 for heating and melting reactionary metals such as titanium and superalloys. Heat sources 28 and 30 are preferably plasma torches although other suitable heat sources such as induction and resistance heaters may be used.

Figure 2:
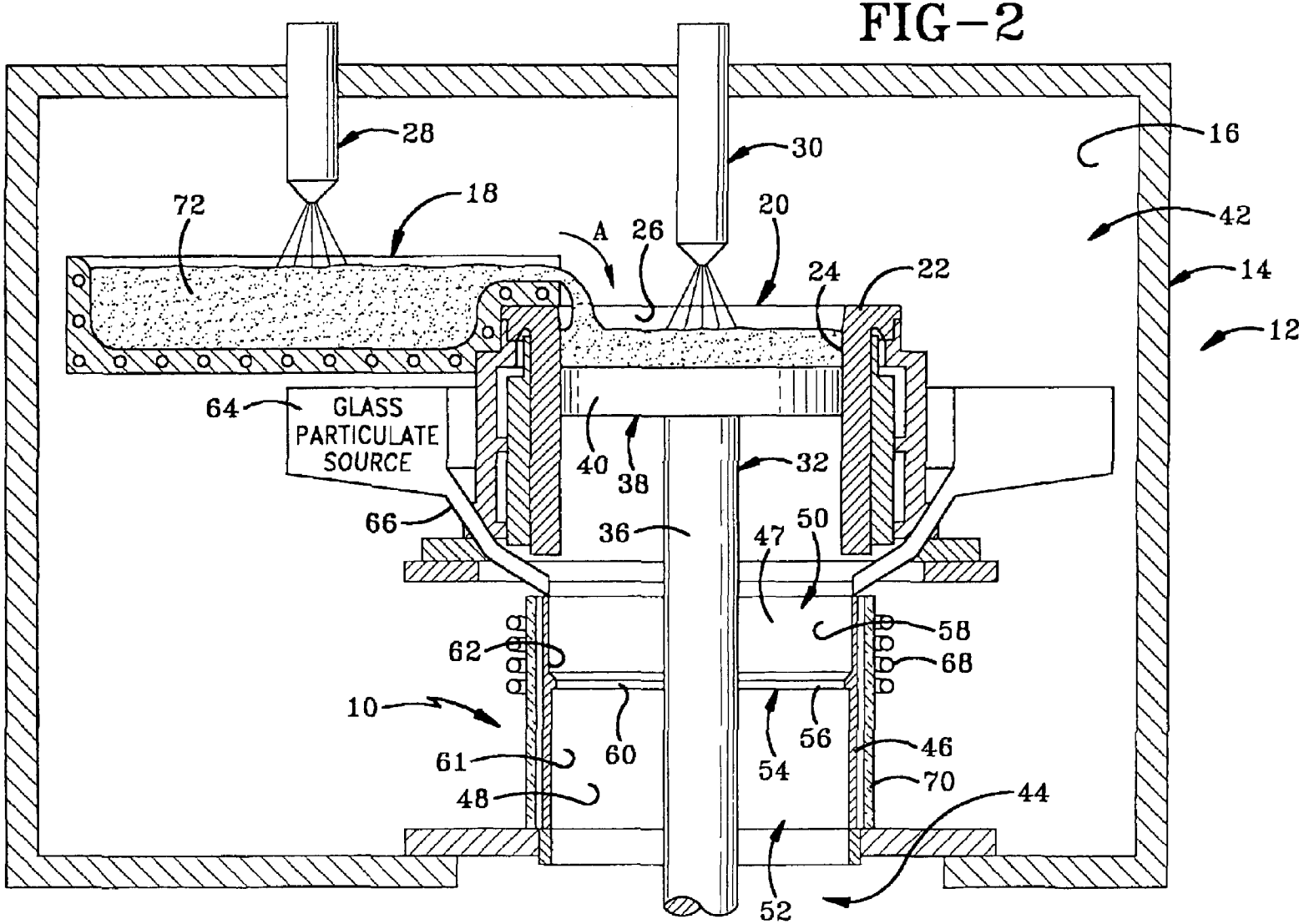
FIG. 2 is similar to FIG. 1 and shows an initial stage of forming an ingot with molten material flowing from the melting/refining hearth into the mold and being heated by heat sources over each of the hearth and mold.
Figure 3:
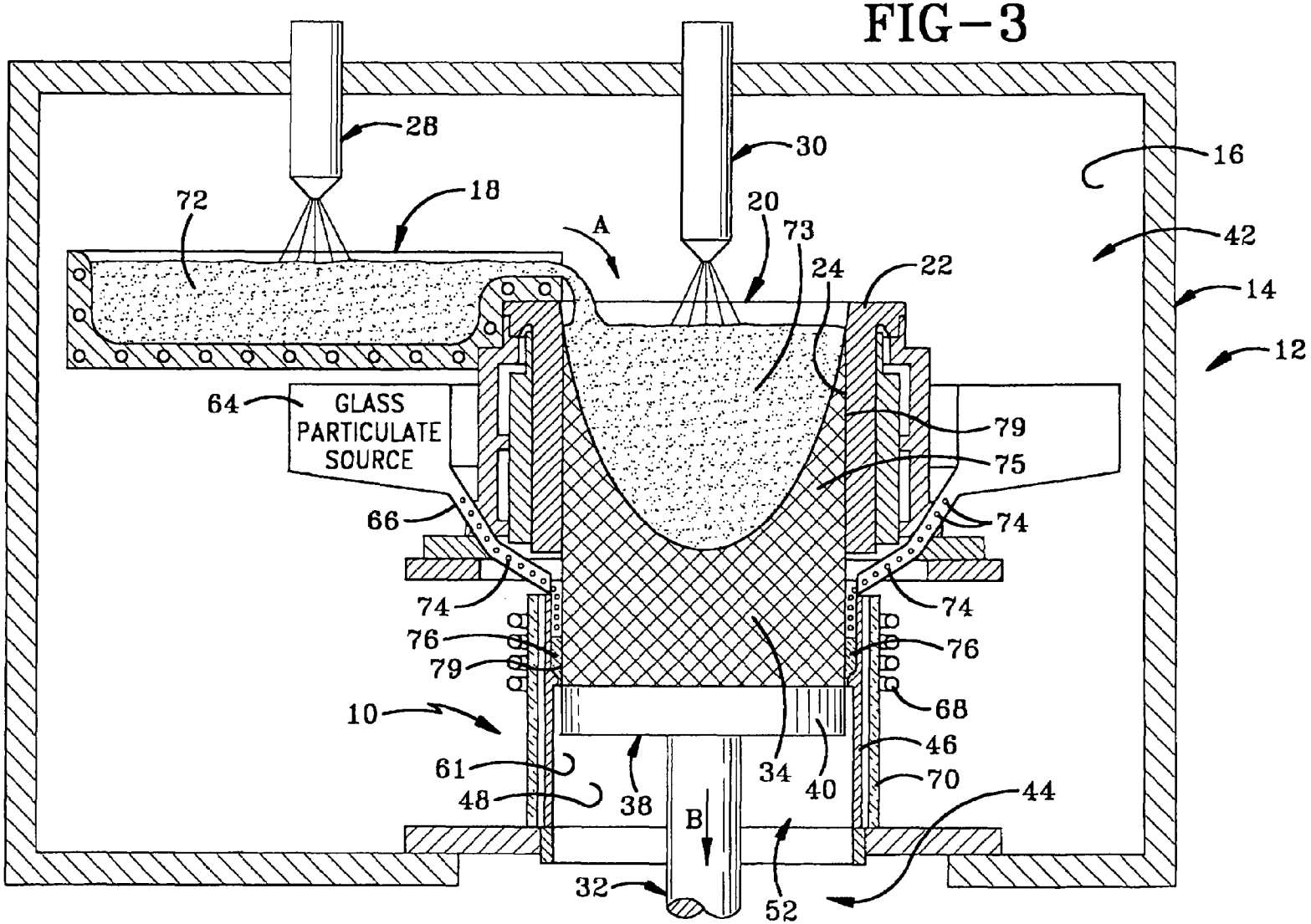
FIG. 3 is similar to FIG. 2 and shows a further stage of formation of the ingot as the ingot is lowered on a lift and into the seal area.
Figure 4:
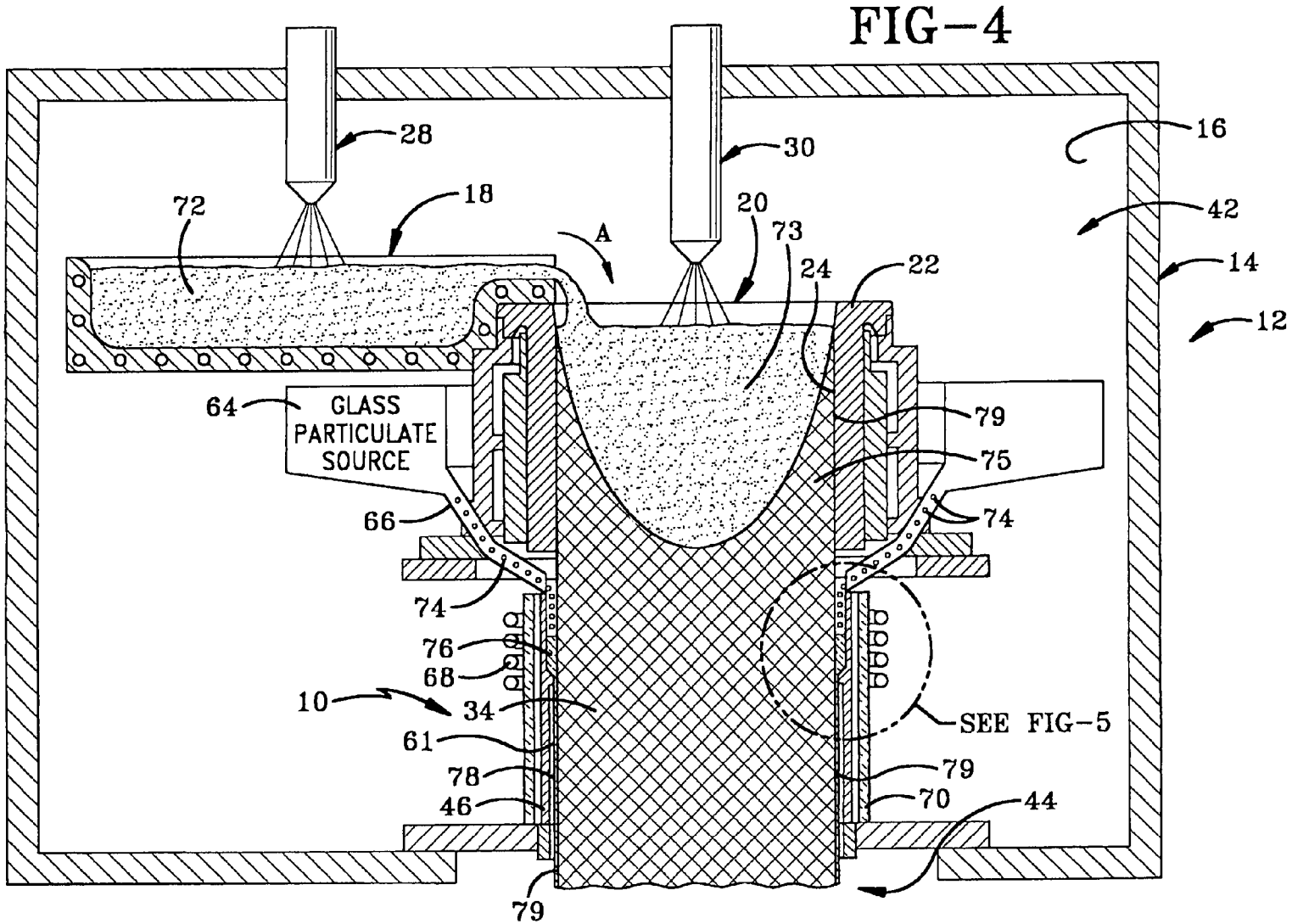
FIG. 4 is similar to FIG. 3 and shows a further stage of formation of the ingot and formation of the glass coating on the ingot.

Furnace 12 further includes a lift or withdrawal ram 32 for lowering a metal cast 34 (FIGS. 2-4). Any suitable withdrawal device may be used. Metal cast 34 may be in any suitable form, such as a round ingot, rectangular slab or the like. Ram 32 includes an elongated arm 36 with a mold support 38 in the form of a substantially cylindrical plate seated atop of arm 36. Mold support 38 has a substantially cylindrical outer surface 40 which is disposed closely adjacent inner surface 24 of mold 20 as ram 32 moves in a vertical direction. During operation, melting chamber 16 contains an atmosphere 42 which is non-reactive with reactive metals such as titanium and superalloys which may be melted in furnace 12. Inert gases may be used to form non-reactive atmosphere 42, particularly when using plasma torches, with which helium or argon are often used, most typically the former. Outside of chamber wall 14 is an atmosphere 44 which is reactive with the reactionary metals when in a heated state.

Seal 10 is configured to prevent reactive atmosphere 44 from entering melting chamber 16 during the continuous casting of reactionary metals such as titanium and superalloys. Seal 10 is also configured to protect the heated metal cast 34 when it enters reactive atmosphere 44. Seal 10 includes a passage wall or port wall 46 having a substantially cylindrical inner surface 47 defining passage 48 therewithin which has an entrance opening 50 and an exit opening 52. Port wall 46 includes an inwardly extending annular flange 54 having an inner surface or circumference 56. Inner surface 47 of port wall 46 adjacent entrance opening 50 defines an enlarged or wider section 58 of passage 48 while flange 54 creates a narrowed section 60 of passage 48. Below annular flange 54, inner surface 47 of port wall 46 defines an enlarged exit section 61 of passage 48.

As later explained, a reservoir 62 for a molten material such as liquid glass is formed during operation of furnace 12 in enlarged section 58 of passage 48. A source 64 of particulate glass or other suitable meltable material such as fused salt or slags is in communication with a feed mechanism 66 which is in communication with reservoir 62. Seal 10 may also include a heat source 68 which may include an induction coil, a resistance heater or other suitable source of heat. In addition, insulating material 70 may be placed around seal 10 to help maintain the seal temperature.

The operation of furnace 12 and seal 10 is now described with reference to FIGS. 2-5. FIG. 2 shows heat source 28 being operated to melt reactionary metal 72 within melting/refining hearth 18. Molten metal 72 flows as indicated by Arrow A into mold cavity 26 of mold 20 and is initially kept in a molten state by operation of heat source 30.

FIG. 3 shows ram 32 being withdrawn downwardly as indicated by Arrow B as additional molten metal 72 flows from hearth 18 into mold 20. An upper portion 73 of metal 72 is kept molten by heat source 30 while lower portions 75 of metal 72 begins to cool to form the initial portions of cast 34. Water-cooled wall 22 of mold 20 facilitates solidification of metal 72 to form cast 34 as ram 32 is withdrawn downwardly. At about the time that cast 34 enters narrowed section 60 (FIG. 2) of passage 48, particulate glass 74 is fed from source 64 via feed mechanism 66 into reservoir 62. While cast 34 has cooled sufficiently to solidify in part, it is typically sufficiently hot to melt particulate glass 74 to form liquid glass 76 within reservoir 62 which is bounded by an outer surface 79 of cast 34 and inner surface 47 of port wall 46. If needed, heat source 68 may be operated to provide additional heat through port wall 46 to help melt particulate glass 74 to ensure a sufficient source of liquid glass 76 and/or help keep liquid glass in a molten state. Liquid glass 76 fills the space within reservoir 62 and narrowed portion 60 to create a barrier which prevents external reactive atmosphere 44 from entering melting chamber 16 and reacting with molten metal 72. Annular flange 54 bounds the lower end of reservoir 62 and reduces the gap or clearance between outer surface 79 of cast 34 and inner surface 47 of port wall 46. The narrowing of passage 48 by flange 54 allows liquid glass 76 to pool within reservoir 62 (FIG. 2). The pool of liquid glass 76 in reservoir 62 extends around metal cast 34 in contact with outer surface 79 thereof to form an annular pool which is substantially cylindrical within passage 48. The pool of liquid glass 76 thus forms a liquid seal. After formation of this seal, a bottom door (not shown) which had been separating non-reactive atmosphere 42 from reactive atmosphere 44 may be opened to allow withdrawal of cast 34 from chamber 16.

Figure 5:
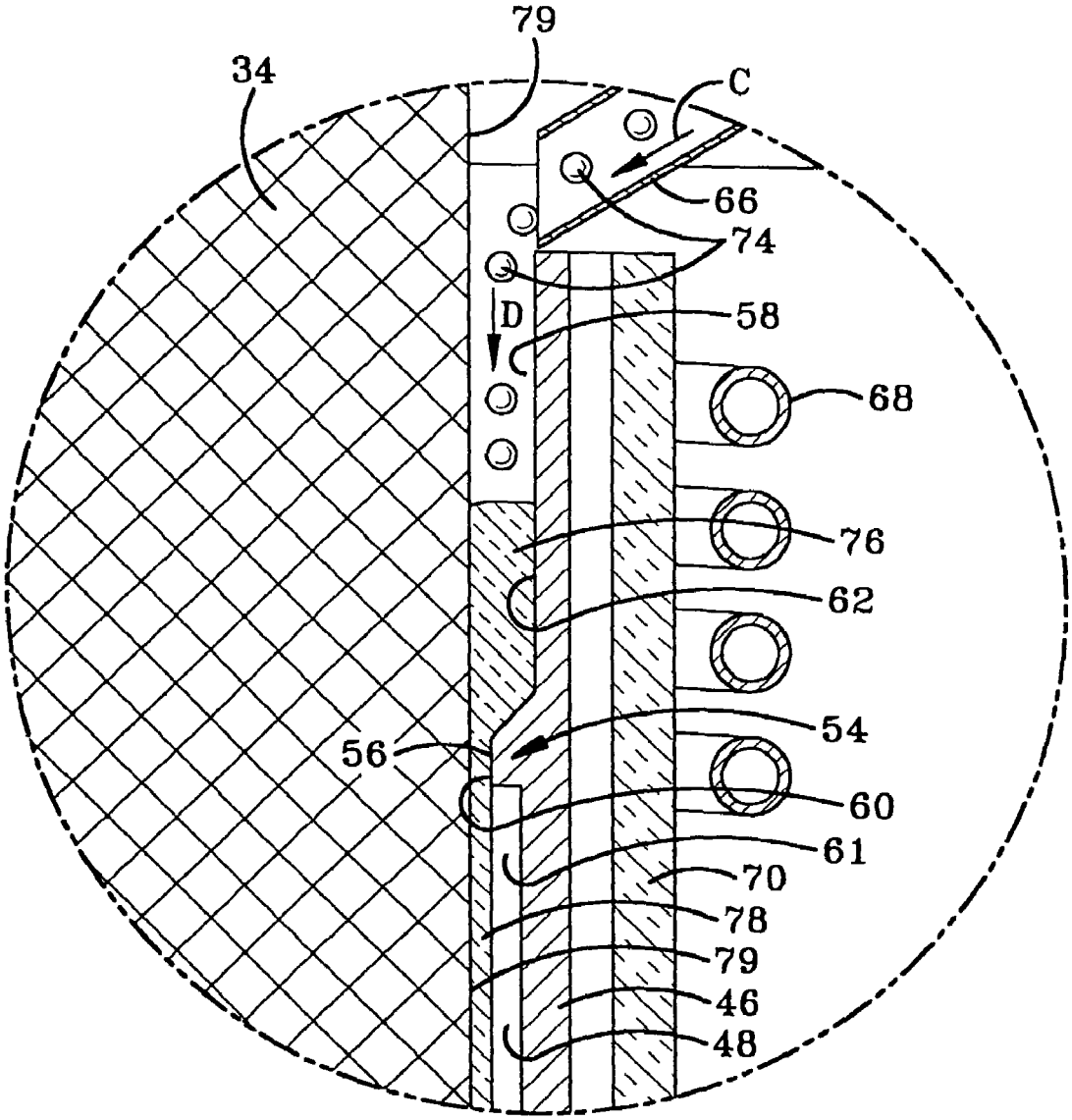
FIG. 5 is an enlarged view of the encircled portion of FIG. 4 and shows particulate glass entering the liquid glass reservoir and the formation of the glass coating.

As cast 34 continues to move downwardly as indicated in FIGS. 4-5, liquid glass 76 coats outer surface 79 of cast 34 as it passes through reservoir 62 and narrowed section 60 of passage 48. Narrowed section 60 reduces the thickness of or thins the layer of liquid glass 76 adjacent outer surface 79 of cast 34 to control the thickness of the layer of glass which exits passage 48 with cast 34. Liquid glass 76 then cools sufficiently to solidify as a solid glass coating 78 on outer surface 79 of cast 34. Glass coating 78 in the liquid and solid states provides a protective barrier to prevent reactive metal 72 forming cast 34 from reacting with reactive atmosphere 44 while cast 34 is still heated to a sufficient temperature to permit such a reaction. Coating 78 also provides an oxidation barrier at lower temperatures.

FIG. 5 more clearly shows particulate glass 74 traveling through feed mechanism 66 as indicated by Arrow C and into enlarged section 58 (Arrow D) of passage 48 into reservoir 62 where particulate 74 is melted to form liquid glass 76. FIG. 5 also shows the formation of the liquid glass coating in narrowed section 60 of passage 48 as cast 34 moves downwardly. FIG. 5 also shows an open space between glass coating 78 and port wall 46 within enlarged exit section 61 of passage 48 as cast 34 with coating 78 moves through section 61.

Figure 7:
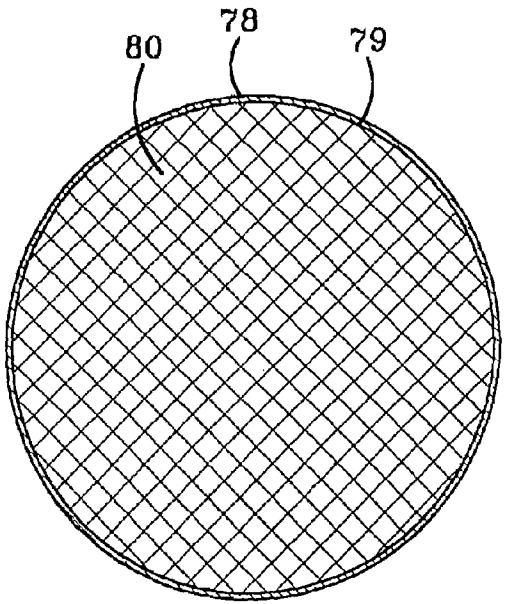
FIG. 7 is a sectional view taken on line 7-7 of FIG. 6.
Figure 6:
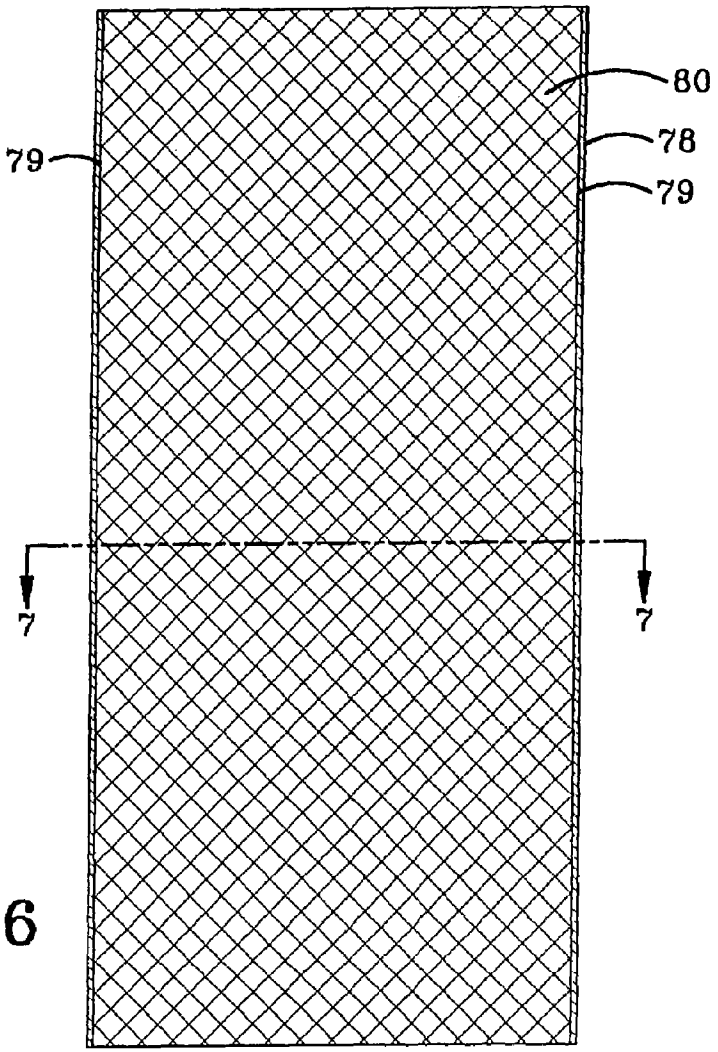
FIG. 6 is a sectional view of the ingot after being removed from the melting chamber of the furnace showing the glass coating on the outer surface of the ingot.

Once cast 34 has exited furnace 12 to a sufficient degree, a portion of cast 34 may be cut off to form an ingot 80 of any desired length, as shown in FIG. 6. As seen in FIGS. 6 and 7, solid glass coating 78 extends along the entire circumference of ingot 80.

Thus, seal 10 provides a mechanism for preventing the entry of reactive atmosphere 44 into melting chamber 16 and also protects cast 34 in the form of an ingot, bar, slab or the like from reactive atmosphere 44 while cast 34 is still heated to a temperature where it is still reactive with atmosphere 44. As previously noted, inner surface 24 of mold 20 is substantially cylindrical in order to produce a substantially cylindrical cast 34. Inner surface 47 of port wall 46 is likewise substantially cylindrical in order to create sufficient space for reservoir 62 and space between cast 34 and inner surface 56 of flange 54 to create the seal and also provide a coating of appropriate thickness on cast 34 as it passes downwardly. Liquid glass 76 is nonetheless able to create a seal with a wide variety of transverse cross-sectional shapes other than cylindrical. The transverse cross-sectional shapes of the inner surface of the mold and the outer surface of the cast are preferably substantially the same as the transverse cross-sectional shape of the inner surface of the port wall, particularly the inner surface of the inwardly extending annular flange in order that the space between the cast and the flange is sufficiently small to allow liquid glass to form in the reservoir and sufficiently enlarged to provide a glass coating thick enough to prevent reaction between the hot cast and the reactive atmosphere outside of the furnace. To form a metal cast suitably sized to move through the passage, the transverse cross-sectional shape of the inner surface of the mold is smaller than that of the inner surface of the port wall.

Additional changes may be made to seal 10 and furnace 12 which are still within the scope of the present invention. For example, furnace 12 may consist of more than a melting chamber such that material 72 is melted in one chamber and transferred to a separate chamber wherein a continuous casting mold is disposed and from which the passage to the external atmosphere is disposed. In addition, passage 48 may be shortened to eliminate or substantially eliminate enlarged exit section 61 thereof. Also, a reservoir for containing the molten glass or other material may be formed externally to passage 48 and be in fluid communication therewith whereby molten material is allowed to flow into a passage similar to passage 48 in order to create the seal to prevent external atmosphere from entering the furnace and to coat the exterior surface of the metal cast as it passes through the passage. In such a case, a feed mechanism would be in communication with this alternate reservoir to allow the solid material to enter the reservoir to be melted therein. Thus, an alternate reservoir may be provided as a melting location for the solid material. However, reservoir 62 of seal 10 is simpler and makes it easier to melt the material using the heat of the metal cast as it passes through the passage.

The seal of the present invention provides increased productivity because a length of the cast can be cut off outside the furnace while the casting process continues uninterrupted. In addition, yield is improved because the portion of each cast that is exposed when cut does not contain shrinkage or pipe cavities and the bottom of the cast does not have a dovetail. In addition, because the furnace is free of a withdrawal chamber, the length of the cast is not limited by such a chamber and thus the cast can have any length that is feasible to produce. Further, by using an appropriate type of glass, the glass coating on the cast may provide lubrication for subsequent extrusion of the cast. Also the glass coating on the cast may provide a barrier when subsequently heating the cast prior to forging to prevent reaction of the cast with oxygen or other atmosphere.

While the preferred embodiment of the seal of the present invention has been described in use with glass particulate matter to form a glass coating, other materials may be used to form the seal and glass coating, such as fused salt or slags for instance.

The present apparatus and process is particularly useful for highly reactive metals such as titanium which is very reactive with atmosphere outside the melting chamber when the reactionary metal is in a molten state. However, the process is suitable for any class of metals, e.g. superalloys, wherein a barrier is needed to keep the external atmosphere out of the melting chamber to prevent exposure of the molten metal to the external atmosphere.

Figure 8:
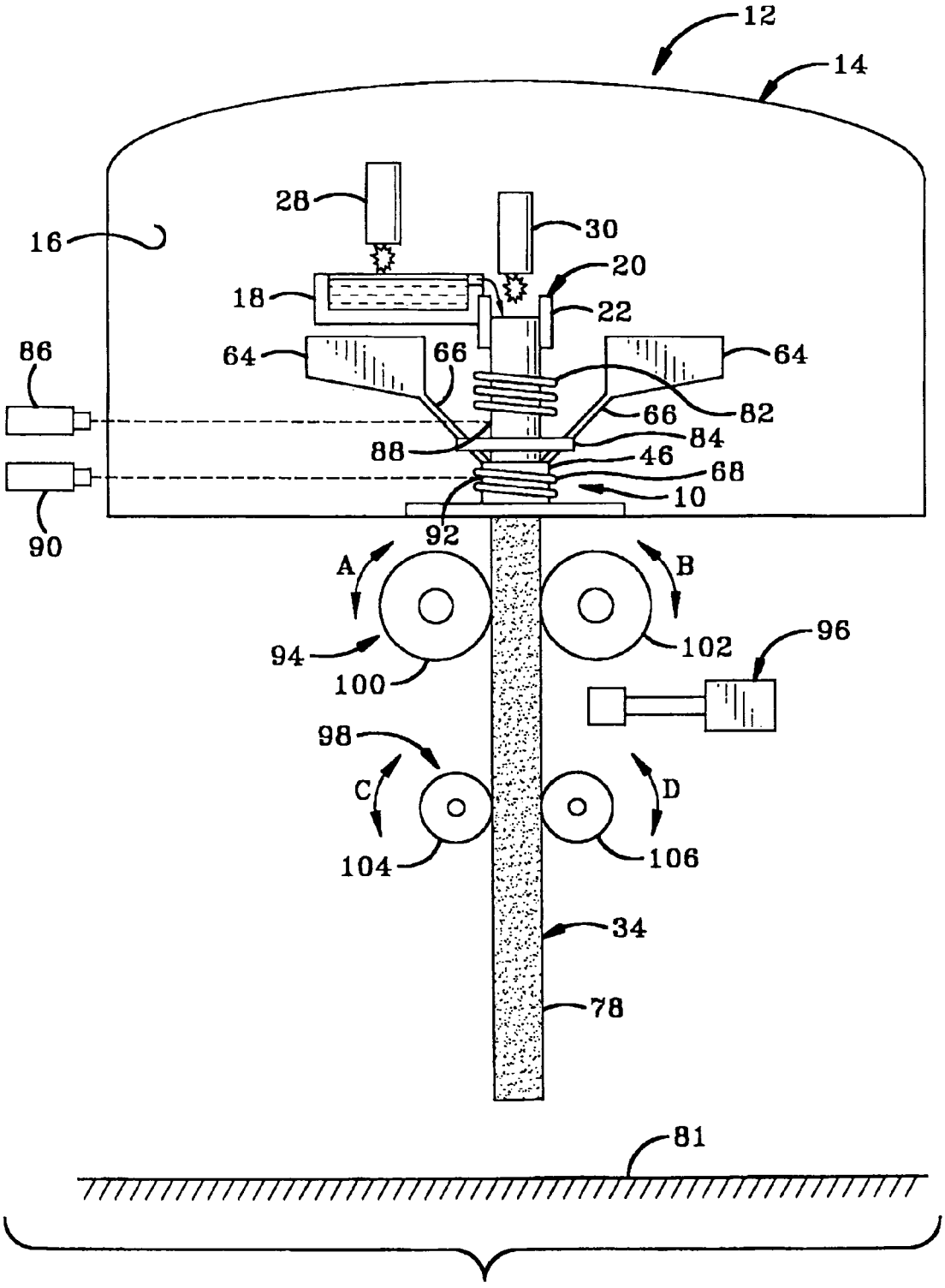
FIG. 8 is a diagrammatic elevational view of the continuous casting furnace of the present invention showing the ingot drive mechanism, the ingot cutting mechanism and the ingot handling mechanism with the newly produced coated metal cast extending downwardly external to the melting chamber and supported by the ingot drive mechanism and ingot handling mechanism.

With reference to FIG. 8, casting furnace 12 is further described. Furnace 12 is shown in an elevated position above a floor 81 of a manufacturing facility or the like. Within interior chamber 16, furnace 12 includes an additional heat source in the form of an induction coil 82 which is disposed below mold 20 and above port wall 46. Induction coil 82 circumscribes the pathway through which metal cast 34 passes during its travel toward the passage within passage wall 46. Thus, during operation, induction coil 82 circumscribes metal cast 34 and is disposed adjacent the outer periphery of the metal cast for controlling the heat of metal cast 34 at a desired temperature for its insertion into the passage in which the molten bath is disposed.

Also within interior chamber 16 is a cooling device in the form of a water cooled tube 84 which is used for cooling conduit 66 of the feed mechanism or dispenser of the particulate material in order to prevent the particulate material from melting within conduit 66. Tube 84 is substantially an annular ring which is spaced outwardly from metal cast 34 and contacts conduit 66 in order to provide for a heat transfer between tube 84 and conduit 66 to provide the cooling described.

Furnace 12 further includes a temperature sensor in the form of an optical pyrometer 86 for sensing the heat of the outer periphery of metal cast 34 at a heat sensing location 88 disposed below induction coil 82 and above port wall 46. Furnace 12 further includes a second optical pyrometer 90 for sensing the temperature at another heat sensing location 92 of port wall 46 whereby pyrometer 90 is capable of determining the temperature of the molten bath within reservoir 62.

External to and below the bottom wall of chamber wall 14, furnace 12 includes an ingot drive system or lift 94, a cutting mechanism 96 and a removal mechanism 98. Lift 94 is configured to lower, raise or stop movement of metal cast 34 as desired. Lift 94 includes first and second lift rollers 100 and 102 which are laterally spaced from one another and are rotatable in alternate directions as indicated by Arrows A and B to provide the various movements of metal cast 34. Rollers 100 and 102 are thus spaced from one another approximately the same distance as the diameter of the coated metal cast and contact coating 78 during operation. Cutting mechanism 96 is disposed below rollers 100 and 102 and is configured to cut metal cast 34 and coating 78. Cutting mechanism 96 is typically a cutting torch although other suitable cutting mechanisms may be used. Removal mechanism 98 includes first and second removal rollers 104 and 106 which are spaced laterally from one another in a similar fashion as rollers 100 and 102 and likewise engage coating 78 of the coated metal cast as it moves therebetween. Rollers 104 and 106 are rotatable in alternate directions as indicated at Arrows C and D.

Additional aspects of the operation of furnace 12 are described with reference to FIGS. 8-10. Referring to FIG. 8, molten metal is poured into mold 20 as previously described to produce metal cast 34. Cast 34 then moves downwardly along a pathway from mold 20 through the interior space defined by induction coil 82 and into the passage defined by passage wall 46. Induction coils 82 and 68 and pyrometers 86 and 90 are part of a control system for providing optimal conditions to produce the molten bath within reservoir 62 to provide the liquid seal and coating material which ultimately forms protective barrier 78 on metal cast 34. More particularly, pyrometer 86 senses the temperature at location 88 on the outer periphery of metal cast 34 while pyrometer 90 senses the temperature of passage wall 46 at location 92 in order to assess the temperature of the molten bath within reservoir 62. This information is used to control the power to induction coils 82 and 68 to provide the optimal conditions noted above. Thus, if the temperature at location 88 is too low, induction coil 82 in powered to heat metal cast 34 to bring the temperature at location 88 into desired range. Likewise, if the temperature at location 88 is too high, the power to induction coil 82 is reduced or turned off. Preferably, the temperature at location 88 is maintained within a given temperature range. Likewise, pyrometer 90 assesses the temperature at location 92 to determine whether the molten bath is at a desired temperature. Depending on the temperature at location 92, the power to induction coil 68 may be increased, reduced or turned off altogether to maintain the temperature of the molten bath within a desired temperature range. As the temperature of metal cast 34 and the molten bath is being controlled, water cooled-tube 84 is operated to provide cooling to conduit 66 in order to allow particulate material from source 64 to reach the passage within passage wall 46 in solid form to prevent clogging of conduit 66 due to melting therein.

With continued reference to FIG. 8, the metal cast moves through seal 10 in order to coat metal cast 34 to produce the coated metal cast which moves downwardly into the external atmosphere and between rollers 100 and 102, which engage and lower the coated metal cast downwardly in a controlled manner. The coated metal cast continues downwardly and is engaged by rollers 104 and 106.

Figure 9:
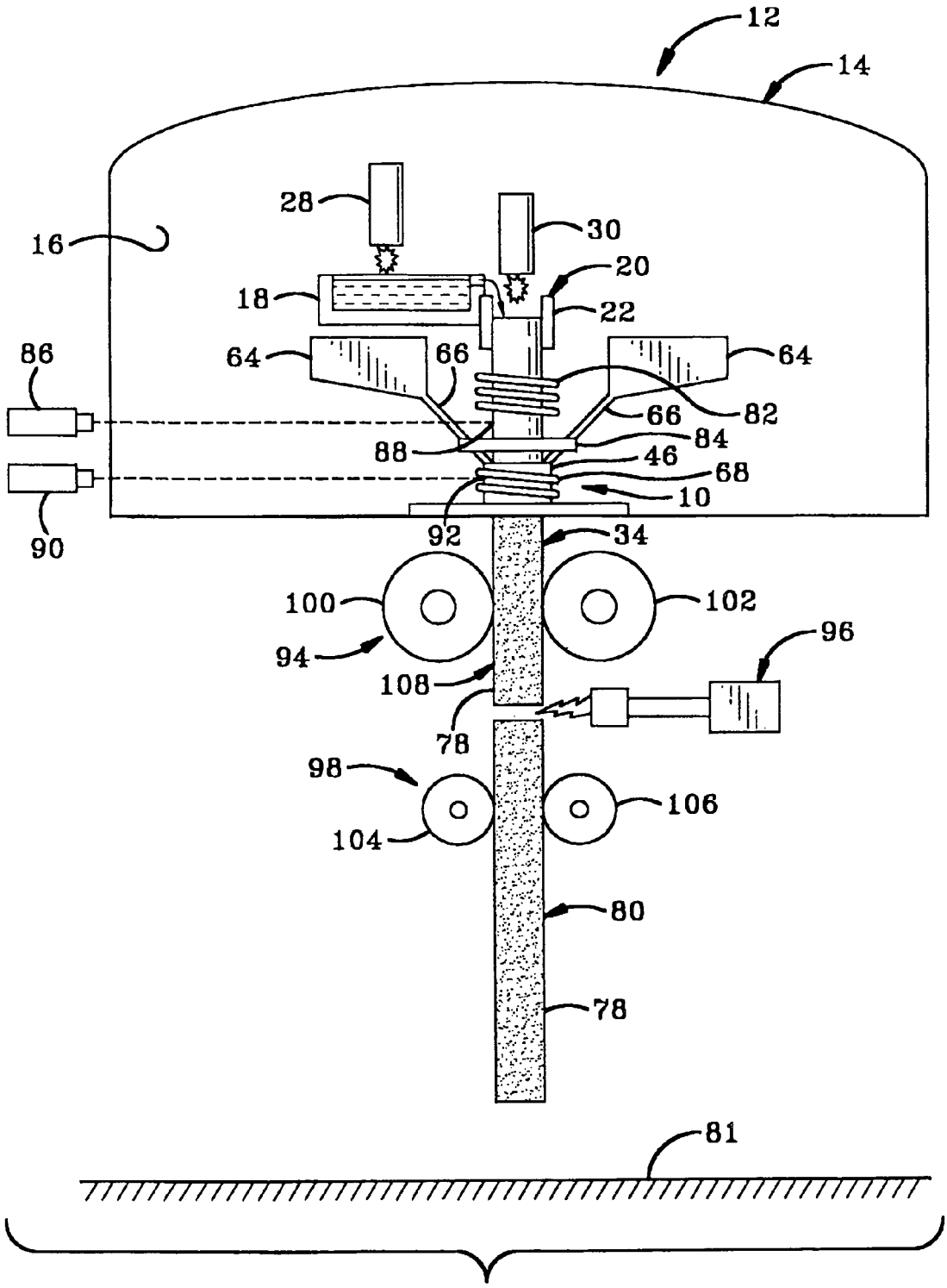
FIG. 9 is similar to FIG. 8 and shows a segment of the coated metal cast having been cut by the cutting mechanism.
Figure 10:
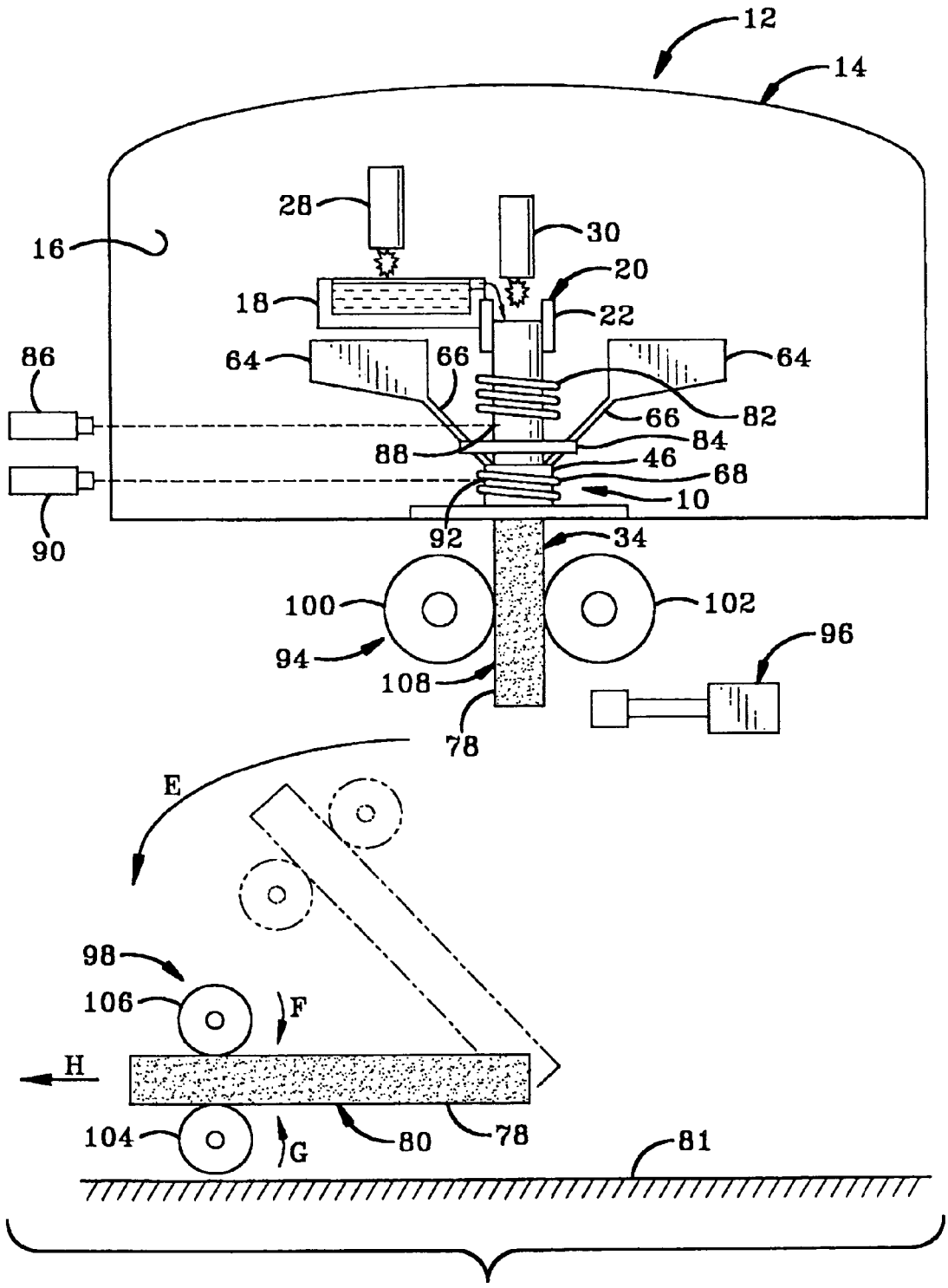
FIG. 10 is similar to FIG. 9 and shows the cut segment having been lowered for convenient handling thereof.

Referring to FIG. 9, cutting mechanism 96 then cuts the coated metal cast to form a cut segment in the form of coated ingot 80. Thus, by the time the coated metal cast reaches the level of cutting mechanism 96, it has cooled to a temperature at which the metal is substantially non-reactive with the external atmosphere. FIG. 9 shows ingot 80 in a cutting position in which ingot 80 has been separated from the parent segment 108 of metal cast 34. Rollers 104 and 106 then rotate as a unit from the receiving or cutting position shown in FIG. 9 downwardly toward floor 81 as indicated by Arrow E in FIG. 10 to a lowered unloading or discharge position in which ingot 80 is substantially horizontal. Rollers 104 and 106 are then rotated as indicated at Arrows F and G to move ingot 80 (Arrow H) to remove ingot 80 from furnace 12 so that rollers 104 and 106 may return to the position shown in FIG. 9 for receiving an additional ingot segment. Removal mechanism 98 thus moves from the ingot receiving position of FIG. 9 to the ingot unloading position of FIG. 10 and back to the ingot receiving position of FIG. 9 so that the production of metal cast 34 and the coating thereof via the molten bath is able to continue in a non-stop manner.

Thus, furnace 12 provides a simple apparatus for continuously casting and protecting metal casts which are reactionary with external atmosphere when hot so that the rate of production is substantially increased and the quality of the end product is substantially improved.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. An apparatus comprising:

a continuous casting mold adapted for producing a metal casting having an outer periphery;

a molten bath of a coating material disposed below the mold and adapted for applying a coating of molten material to an outer periphery of the metal casting to produce a coated metal casting;

a metal casting pathway extending downwardly from the mold to adjacent the molten bath and adapted for movement of the metal casting therein from the mold to the molten bath; and a first temperature sensor for sensing temperature at a first sensing location on the pathway whereby the first temperature sensor is adapted to measure the temperature of the metal casting at the first sensing location.

2. The apparatus of claim 1 further including a first heat source disposed below the mold, above the molten bath and adjacent the pathway whereby the first heat source is adapted for selectively heating the metal casting as it moves along the pathway; and wherein the first temperature sensor is part of a control system configured to control operation of the first heat source in accordance with the temperature sensed at the first sensing location on the pathway by the first temperature sensor.

3. The apparatus of claim 2 wherein the first heat source includes an induction coil which circumscribes the pathway.

4. The apparatus of claim 2 wherein the first sensing location is below the heat source and above the molten bath.

5. The apparatus of claim 4 further including a second heat source disposed outwardly of and adjacent the molten bath for selectively heating the molten bath; and a second temperature sensor for sensing a temperature of the molten bath.

6. The apparatus of claim 5 further including a passage wall having an inner periphery which defines a passage adapted for the metal casting to move through; wherein the inner periphery bounds the molten bath; and wherein the second temperature sensor is configured to sense a temperature of the passage wall whereby the second temperature sensor is configured to sense the temperature of the molten bath.

7. The apparatus of claim 1 further including a source of particulate material and a dispenser for dispensing the particulate material to a location adjacent the molten bath.

8. The apparatus of claim 7 further including a cooling device disposed closely adjacent a portion of the dispenser for cooling the particulate material therein whereby the cooling device is adapted to prevent melting of the particulate material within the dispenser.

9. The apparatus of claim 8 wherein the dispenser includes a conduit for carrying the particulate material; wherein the conduit has an exit end disposed adjacent the molten bath; and wherein the cooling device is disposed closely adjacent the conduit.

10. The apparatus of claim 7 further including a metal casting pathway extending from adjacent the mold to adjacent the molten bath and adapted for movement of the metal casting therein from the mold to the molten bath; wherein the dispenser includes a conduit for carrying the particulate material; and wherein the conduit has an exit end disposed adjacent the pathway.

11. The apparatus of claim 7 further including a passage wall having an inner periphery which defines a passage adapted for the metal casting to move through; wherein the inner periphery bounds the molten bath; and wherein the dispenser is configured to dispense the particulate material to a location within the inner periphery of the passage wall.

12. The apparatus of claim 1 further including a cutting mechanism disposed below the molten bath and adapted for cutting the coated metal casting while extending downwardly from the mold to form cut segments of the coated metal casting; and a removal mechanism disposed below the cutting mechanism and adapted for removing the cut segments of the metal casting from a cutting position at which the cut segments separate from a parent segment of the coated metal casting.

13. The apparatus of claim 12 wherein the removal mechanism includes first and second rotatable removal rollers which are spaced from one another to define therebetween a cut segment engaging space and which are adapted to rollably engage and support one of the cut segments disposed in the space.

14. The apparatus of claim 12 further including a casting-lowering mechanism disposed above the cutting mechanism and adapted for lowering the coated metal casting.

15. The apparatus of claim 1 further including a cutting mechanism disposed below the molten bath and adapted for cutting the coated metal casting while extending downwardly from the mold to form cut segments of the coated metal casting; and a casting-lowering mechanism disposed above the cutting mechanism and adapted for lowering the coated metal casting.

16. The apparatus of claim 15 wherein the lowering mechanism includes first and second rotatable lowering rollers which are spaced from one another to define therebetween a coated metal casting engaging space and which are adapted to rollably engage and support the coated metal casting when disposed in the space.

17. The apparatus of claim 1 further including a melting chamber which has a sidewall and in which the mold is disposed; and a passage wall having an inner periphery defining a passage which extends through the sidewall of the melting chamber and is adapted for movement of the metal casting therethrough; and wherein the molten bath is bounded by the inner periphery of the passage wall.

18. The apparatus of claim 17 further including a hearth defining a molten material containing cavity; and wherein the hearth is disposed within the melting chamber and adapted for transferring molten material therefrom into the mold.

19. In combination, a heated metal casting having an outer periphery and a furnace for producing the metal casting, the furnace comprising:

a continuous casting mold for producing the heated metal casting;

a molten bath of a coating material disposed below the mold for applying a coating of molten material to the outer periphery of the metal casting to produce a coated metal casting;

a source of particulate material;

a dispenser for dispensing the particulate material to a location adjacent the molten bath;

a metal casting pathway extending from adjacent the mold to adjacent the molten bath for transporting the metal casting therein from the mold to the molten bath; and a first heat source disposed below the mold, above the molten bath and adjacent the pathway whereby the first heat source is configured to heat the metal casting as it moves along the pathway so that the heated metal casting radiates heat to the particulate material to facilitate melting the particulate material to form the molten bath.

20. The apparatus of claim 19 wherein the first heat source includes an induction coil which circumscribes the pathway.

21. The apparatus of claim 19 further including a cooling device disposed closely adjacent a portion of the dispenser for cooling the particulate material therein whereby the cooling device is adapted to prevent melting of the particulate material within the dispenser.

22. The apparatus of claim 21 wherein the dispenser includes a conduit for carrying the particulate material; wherein the conduit has an exit end disposed adjacent the molten bath; and wherein the cooling device is disposed closely adjacent the conduit.

23. The apparatus of claim 19 wherein the dispenser includes a conduit for carrying the particulate material; and wherein the conduit has an exit end disposed adjacent the pathway.

24. The apparatus of claim 19 further including a passage wall having an inner periphery which defines a passage adapted for the metal casting to move through; wherein the inner periphery bounds the molten bath; and wherein the dispenser is configured to dispense the particulate material to a location within the inner periphery of the passage wall.

25. The apparatus of claim 19 further including a melting chamber which has a sidewall and in which the mold is disposed; and a passage wall having an inner periphery defining a passage which extends through the sidewall of the melting chamber and is adapted for movement of the metal casting therethrough; and wherein the molten bath is bounded by the inner periphery of the passage wall.

26. An apparatus comprising:

a continuous casting mold adapted for producing a metal casting having an outer periphery;

a molten bath of a coating material disposed below the mold and adapted for applying a coating of molten material to the outer periphery of the metal casting to produce a coated metal casting; and a source of particulate material and a dispenser for dispensing the particulate material to a location adjacent the molten bath.

27. The apparatus of claim 20 further including a cooling device disposed closely adjacent a portion of the dispenser for cooling the particulate material therein whereby the cooling device is adapted to prevent melting of the particulate material within the dispenser.

28. The apparatus of claim 27 wherein the dispenser includes a conduit for carrying the particulate material; wherein the conduit has an exit end disposed adjacent the molten bath; and wherein the cooling device is disposed closely adjacent the conduit.

29. The apparatus of claim 20 further including a metal casting pathway extending from adjacent the mold to adjacent the molten bath and adapted for movement of the metal casting therein from the mold to the molten bath; wherein the dispenser includes a conduit for carrying the particulate material; and wherein the conduit has an exit end disposed adjacent the pathway.

30. The apparatus of claim 20 further including a passage wall having an inner periphery which defines a passage adapted for the metal casting to move through; wherein the inner periphery bounds the molten bath; and wherein the dispenser is configured to dispense the particulate material to a location within the inner periphery of the passage wall.

31. The apparatus of claim 20 further including a melting chamber which has a sidewall and in which the mold is disposed; and a passage wall having an inner periphery defining a passage which extends through the sidewall of the melting chamber and is adapted for movement of the metal casting therethrough; and wherein the molten bath is bounded by the inner periphery of the passage wall.

* * * * *

UNITED STATES PATENT AND TRADEMARK OFFICE

CERTIFICATE OF CORRECTION

PATENT NO. : 7,484,548 B2
APPLICATION NO. : 11/433107
DATED : February 3, 2009
INVENTOR(S) : Jacques et al.

It is certified that error appears in the above-identified patent and that said Letters Patent is hereby corrected as shown below:

Claim 27
Column 10, line 38 change claim dependency from claim "20" to "26" -- The apparatus of claim 26 further including a cooling device --

Claim 29
Column 10, line 48 change claim dependency from claim "20" to "26" -- The apparatus of claim 26 further including a metal casting --

Claim 30
Column 10, line 55 change claim dependency from claim "20" to "26" -- The apparatus of claim 26 further including a passage wall --

Claim 31
Column 10, line 61 change claim dependency from claim "20" to "26" -- The apparatus of claim 26 further including a melting chamber --

Signed and Sealed this

Twenty-fourth Day of March, 2009

John Doll

JOHN DOLL
*Acting Director of the United States Patent and Trademark Office*